United States Patent [19]

Kemmetmüller

[11] 4,037,330

[45] July 26, 1977

[54] METHOD AND MEANS FOR DRY COOLING BULK MATERIALS

[75] Inventor: Roland Kemmetmüller, Vienna, Austria

[73] Assignee: Waagner-Biro Aktiengesellschaft, Austria

[21] Appl. No.: 687,006

[22] Filed: May 17, 1976

[30] Foreign Application Priority Data

June 13, 1975 Austria ..... 4530/75

[51] Int. Cl.[2] ..... F26B 7/00; F26B 21/06

[52] U.S. Cl. ..... 34/20; 34/75; 34/77; 432/77

[58] Field of Search ..... 34/20, 75, 77, 79, 86; 432/77; 201/34

[56] References Cited

U.S. PATENT DOCUMENTS

| | | | |
|---|---|---|---|
| 3,837,792 | 9/1974 | Deussner | 432/77 |
| 3,959,084 | 5/1976 | Price | 34/20 |

*Primary Examiner*—John J. Camby

*Attorney, Agent, or Firm*—Reed, Smith, Shaw & McClay

[57] ABSTRACT

The invention disclosed is addressed to a method and means of dry cooling bulk material within a closed system in which said material is usually supplied intermittently to a cooling station. The method comprises directing a substantially continuous stream of cooling gas through the bulk material to thereby cool it and at the same time heat the stream of cooling gas. The heated stream of cooling gas is removed from the bulk material and directed through a mixing zone where it is mixed with a stream of cold cooling gas. Preferably, the hot mixed gas is cleaned and thereafter cooled by passage through a heat exchanger means. A selected portion of the cold cooling gas is diverted from the main stream to the mixing zone for mixing with the heated stream from the bulk material. The nondiverted portion of the cold cooling gas is directed to and through the bulk material.

16 Claims, 1 Drawing Figure

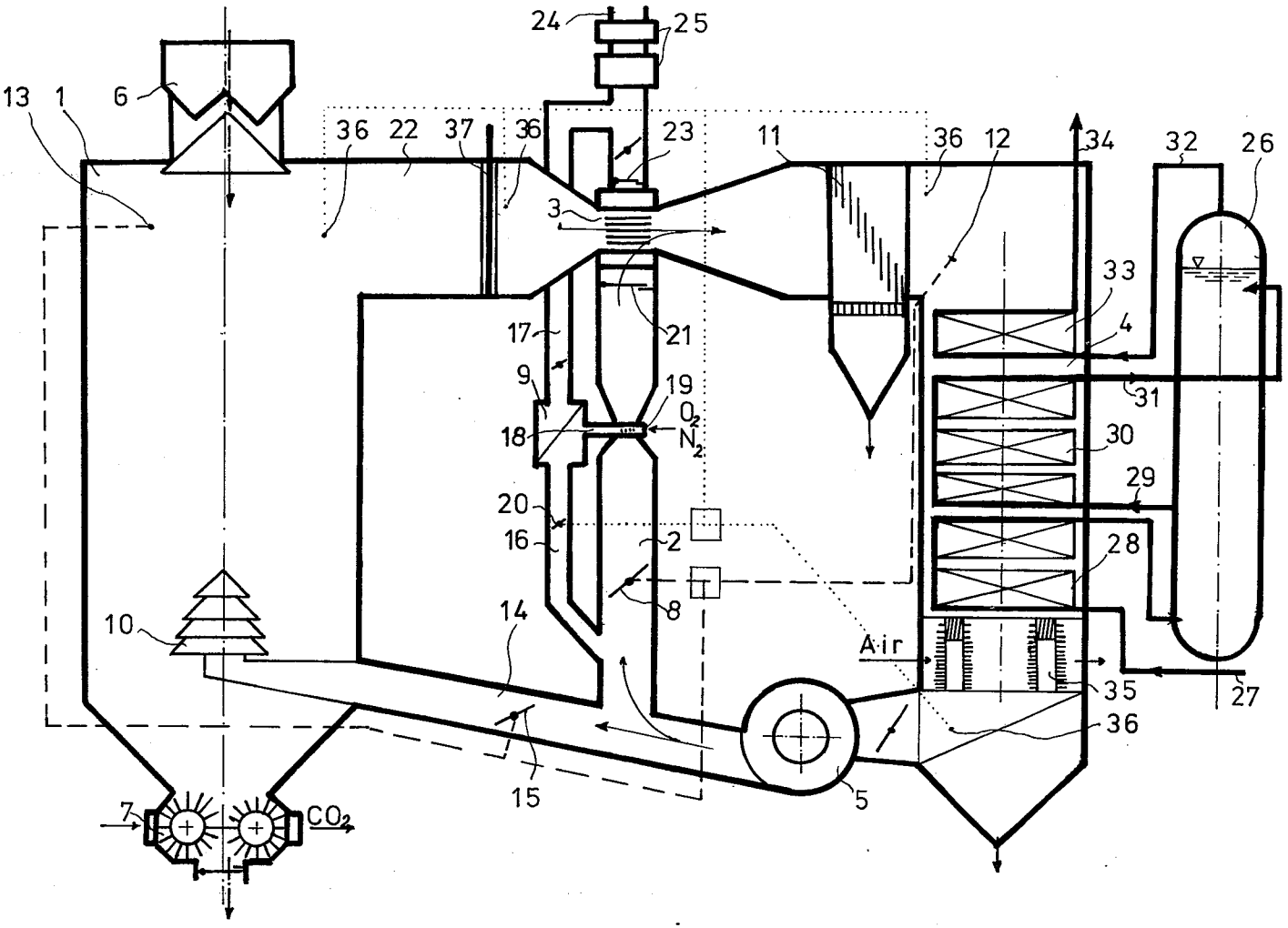
Air
$O_2$
$N_2$
$CO_2$

METHOD AND MEANS FOR DRY COOLING BULK MATERIALS

FIELD OF THE INVENTION

The present invention relates to a method and means for dry cooling hot bulk material in a closed circuit, and, in particular, to a method and means for cooling bulk material such as lime clinker, calcinated ore, sinter or coke, wherein said material is intermittently supplied to a cooling station within the closed circuit and wherein said gas stream is also cooled within the circuit.

BACKGROUND OF THE INVENTION

The dry cooling of bulk material is old and generally well known. For example, dry coke quenching has been known for over 50 years, and is presently practiced in the Soviet Union using what is known as the Giprokoks system.

Dry cooling of bulk material, particularly materials such as coke, permits recovery of substantial amounts of energy, which, for example, can be utilized in the production of electrical power. If electrical power generation is considered, recovered heat would be equivalent to about 100kw/ton of coke. Additionally, dry cooling in a closed circuit greatly reduces atmospheric pollution which has become associated with such things as the wet quenching of coke. Accordingly, dry cooling of materials provides substantial advantages to the environment and for the recovery of energy. Notwithstanding these advantages, various technical difficulties exist in both the methods and the apparatus for dry cooling.

For the most part, the bulk material supplied to the dry cooling means is supplied on an intermittent basis. For example, in a coking operation, the coke would be pushed and transferred in the incandescent state to the dry cooling system. The coke is supplied after each pushing operation so there is no steady state flow of material into the system, but rather an irregular flow of hot material.

The intermittent supplying of hot material causes considerable heat fluctuation in the temperature of circulating gas. This in turn complicates the construction of the heat exchanger as well as requiring expensive apparatus to obtain and maintain a constant heat supply. For example, the Giprokoks system for dry quenching coke utilizes a pre-chamber within a cooling bunker to store incandescent coke without it being cooled. The stored hot coke enters cooling zone only as a result of coke withdrawal at the discharge end, and, the hot gases escape through a series of ducts leading to an annular channel around the pre-chamber. Also, fluctuation in heat creates problems with respect to the cleaning of dust-laden cooling gas prior to its introduction into a heat exchanger, because the cleaning means must be designed for peak temperature values which the system may experience.

Other problems which have heretofore been associated with systems used in dry cooling relate to the degasification, for example, of hot coke. Problems can arise where the hot materials are cooled by a substantially inert cooling gas when hydrocarbons and carbon monoxide build up within the system and form an explosive mixture. Such an enrichment of carbon monoxide can also occur in installations for calcinated ore caused by the interaction of carbon dioxide with the remaining carbon. If the carbon monoxide gas and hydrogen compounds are present, an increased danger of explosion exists if there is also an enrichment of oxygen present. Similar phenomena occur in installations for cooling sinter material or clinker wherein the changes of chemical compounds of the cooling gas, especially the concentration of sulfur dioxide, can cause difficulties, including, for example, changes in the chemical composition of the sinter or clinker materials.

It is, therefore, an object of the present invention to provide a method and means whereby the temperature of the cooling gas prior to its passage through a heat exchanger is controllably maintained at a substantially constant temperature notwithstanding fluctuation in the heat input to the circuit. It is a further object of the present invention to maintain a constant quantity of cooling gas passing through the heat exchanger, and to continuously condition the cooling gas so as to avoid or maintain within permissible limits any build-up of dangerous gases or changes in the chemical composition of the cooling gas.

SUMMARY OF THE INVENTION

With respect to the present invention, hot bulk material is discharged into a cooling bunker or station within a closed system from a transfer means. The material is typically supplied to the cooling station on an intermittent basis such as after the pushing of coke. Generally, the present invention comprises directing a substantially continuous stream of inert cooling gas, preferably in a counter flow direction, through the bulk material within the cooling station to remove heat therefrom. In the case of coke, for example, the residence time within the cooling station is from about 3 to 4 hours. The stream of cooling gas, typically heated from about 150° C to 900° - 1000° C, is removed from the cooling station and directed through a mixing zone where it is mixed with cold cooling gas having a temperature of from about 100° C to 200° C. The proportion of cold cooling gas to hot cooling gas is carefully adjusted to maintain the temperature of the mixed gases at about 500° to 600° C.

This mixture of hot and cold cooling gas is directed to a coarse particle separator and then introduced into a heat exchanger where it is cooled to about 100° to 150° C. Preferably, the heat exchanger includes means for quenching steam for use in the generation of electrical power. Alternatively, the recovered heart can be used for other purposes such as pre-heating the bulk material, for example, in heating the coal used for coking. The cooled cooling gas is further cleaned using fine particle separators preferably located at the discharge end of the heat exchanger and prior to passing through the circulation fans.

A selected portion of cold cooling gas from the heat exchanger is diverted to the mixing zone and mixed with the hot gas removed from the bulk material. Diversion of the gas is achieved by means of a by-pass or division line positioned to communicate with the main line leading from the heat exchanger/circulation fans to the cooling station. The undiverted portion of cold gas is directed to the cooling station by means of the main line from the blower to cool the bulk material.

Bulk material adjacent to the discharger end of the cooling station is cooled to less than about 200° C. The cooled material is discharged from the system through a lock system to avoid loss of cooling gas.

Preferably, the selectively diverted portion of the cooled gas stream is directed through a gas conditioning means located within or as a part of the by-pass or diversion line. The conditioning means preferably controls the gas analysis of the circulating cooling gas to eliminate the accumulation of explosive gas and to maintain chemical constituents of the bulk material.

By proper flow of cold cooling gas through by-pass line to the mixing zone, both the temperature and quantity of the cooling gas leaving the zone can be maintained within relatively constant limits. To achieve control over the flow, and provide selective diversion, throttle valves are positioned within the main line from the heat exchanger/circulation fan after the by-pass junction as well as within the by-pass line itself. A slide valve is interpositioned in the outlet line from the cooling station to the mixing zone for use primarily during start-up. Both pressure and temperature gauges are located within the system to provide constant monitoring of said parameter, and which provide input signals to control the various throttle valves.

Because of the capability to maintain a constant temperature ahead of the heat exchanger as well as the preferred gas cleaner, constant steam production cam be achieved. Moreover, where the time between supply of hot bulk material is long, for example, one hour, the present invention permits the bulk material to act as a heat storage device thus eliminating any variation in the production of steam. Also, unlike previous systems, there are no complex cooling bunker designs which require the use of pre-chambers. Other advantages of the present invention will become apparent from a perusal of the following detailed description taken in connection with the accompanying drawing.

BRIEF DESCRIPTION OF THE DRAWINGS

The drawing is a diagrammatic illustration of means for dry cooling bulk material and in particular for use in dry coke quenching.

PRESENTLY PREFERRED EMBODIMENT

With reference to the drawing, a closed system for dry cooling fluid bulk material, such as lime clinker, calcinated ore, sinter or coke is shown. Closed system of the present invention includes a cooling bunker or station 1 for receiving bulk material to be cooled. Cooling bunker 1 is preferably made of a refractory material capable of withstanding temperatures from up to between 900° C and 1200° C. Positioned at the upper end of cooling bunker 1 is air lock 6 through which hot bulk material is supplied. Typically, for example, material such as coke is pushed from a coke oven and collected in a closed transfer means (not shown). The transfer means is positioned on the top of the cooling bunker, by a crane means (not shown), for example, and opened to discharge incandescent coke into the bunker.

At the bottom or discharge end of the cooling bunker 1 is lock gate 7 which may comprise, for example, a pair of roller crushers or other like means which crush material during discharge into a desired particle size. Preferably, lock gate 7 is provided with internal cooling ducts adapted to receive a cooling fluid, such as liquid carbon dioxide or the like, to cool any hot spots that may exist in the bulk material. This further cooling serves to protect the surface of a conveyor (not shown) which is preferably positioned below the discharge outlet to remove the cooled material to a transfer station. It is clear, however, that further cooling may be unnecessary so that internal cooling ducts may be dispensed with.

Positioned within cooling bunker 1, preferably at the bottom thereof, is cooling gas distributor 10 which is connected to main inlet line 14. Distributor 10 directs the cooling gas into bunker 1 so as to flow upwardly from the bottom to the top of the cooling bunker in a counterflow direction to the direction of material within bunker 1. The residence time of coke within the cooling bunker can vary, but it is preferably from 3 to 4 hours. A temperature differential exists across the material within bunker 1 from below about 200° C. which is the preferred discharge temperature, to 1150° C at the top for pushed coke.

Preferably, the cooling-gas used in the present invention is a gas which is inert to the material being cooled. For example, in dry coke quenching the cooling gas should be pure nitrogen. With nitrogen, undesired changes in the cooling gas caused by the reaction $C0_2 + C = 2C0$, $H_2O$, $+C = H_2 + C0$, respectively, may be avoided as well as subsequent loss of coke by oxidation may be prevented.

The hot cooling gas is directed from the cooling bunker 1 through outlet duct 22 located at the top of the bunker. In the case of coke quenching, the hot cooling gases leave the bunker at various temperatures from approximately 650° C to between 900° – 1000° C. Outlet duct 22 discharges into mixing nozzle or zone 3 for mixing the hot cooling gas leaving bunker 1 with cold cooling gas from diversion or by-pass line 2 (described in more detail hereinafter) through nonreturn valve 21. This mizing is accurately controlled to lower the temperature of the hot gases at the outlet of mixing zone 3 to approximately 550° – 650° C.

Typically, the hot cooling gas leaving cooling bunker 1 is entrained with undesirable particles from the bulk material. Accordingly, it is preferable to include a cleaning device, such as an impingement separator or like coarse particle separator 11 at the discharge end of mixing zone 3 to protect the steam generator/heat exchanger from abrasive wear. The cleaned hot cooling gas is discharged from cleaning device 11 into heat exchanger 4 wherein it is cooled to approximately 100° – 150° C. At the outlet end of heat exchanger 4 is circulation fan 5 used to circulate the cooling gas through the system. Circulation fan 5 is connected to distributor 10 by means of main inlet duct 14.

Positioned in communication with duct 14 is by-pass line or diversion line 2 for selectively directing a portion of the cold cooling gas stream to mixing zone 3 for mixing with hot cooling gas from cooling bunker 1. Preferably, by-pass line 2 includes a conditioning means 9 for the cooling gas for the purpose of eliminating any possible enrichment of explosive constituents or minimizing within permissible limits constituents by filtration. With respect to dry coke quenching, for example, conditioning means 9 preferably includes a nitrogen producing installation. Conditioning means 9 is in operable communication with by-pass line 2 by means of inlet line 16 having throttle valve 20 positioned therein to regulate the quantity of cooling gas brought into line 16. Conditioning means 9 includes a waste duct 17 for directing gas from means 9 to a vent line 24. In order to blowdown the overpressure, vent line 24 is preferably provided with a bleeder valve 23. In a nitrogen producing installation, a fuel is burnt and the combustion gases are directed through a molecular sieve (not shown) which separates the nitrogen from the undesired products of combustion. The products of combustion are discharged through waste gas duct 17. The inert gas (nitrogen in the case of coke dry quenching) is directed through duct 18 into mixing device 19 positioned within diversion line 2.

Conditioning means 9 may also act upon the combustion of fuel gases wherein low concentrates of the combustible gas are burnt and the hydrogen compounds as well as the carbon compounds directed either through a moleuclar sieve into the waste gas ducts 17 for discharge into the atmosphere or are directed back to the circulating cooling gas. Operation of conditioning means 9 is regulated by means of, preferably a plurality of gas analyzers 36 positioned at various stations within the cooling gas circuit. Additionally, conditioning means 9 can be used as supplementary cooling means in order to insure complete and effective control of the temperature within the circuit.

Operation of the closed circuit is preferably maintained at no pressure differential atmosphere and the hot discharge end of cooling bunker 1 or at reduced pressure. However, if over pressure of cooling gas should occur in discharge line 22, bleeder valve 23 opens into vent line 24 reduce any over pressure within the system. Vent line 24 includes cleaning device 25, preferably an installation for the combustion of fuel gas with a dust separator connected in series, to clean the hot waste gases prior to discharge to the atmospshere.

By properly regulating the portion of cold cooling gas discharged from diversion line 2 into mixing zone 3, constant temperature can be maintained at the inlet portion of heat exchanger 4. Selective regulation of the quantity of gas discharged into mixing zone 3 is affected by throttle valve 8 located within diversion line 2 and temperature sensing gauge 12 positioned at the inlet end of the heat exchanger 4. Temperature gauge 12 is in communication with valve 8 and is used to sense the temperature of the gas entering heat exchanger 4 to maintain a constant temperature of gas entering said exchanger. Additional control is provided by pressure gauge 13 also in communication with valve 8 and which is located within the outlet gas chamber portion of cooling bunker 1. To further effect control over the flow of cooling gas within the circuit, throttle valve 15 positioned within line 14 to distributor 10 is provided. Also, positioned within line 22 is control slide valve 37 to disconnect cooling bunker 1 from mixing device 3. Typically, slide 37 is used when starting the device in operation.

Preferably, heat exchanger 4 comprises a steam generator with vertical steam drum 26. Feedwater is directed through duct 27 to feedwater heater 28 in steel drum 26. Hot water is directed by means of duct 29 from water heat 28 to vaporizing coils 30 located within heat exchanger 4. Thereafter, a mixture of steam and water is directed through duct 31 to the upper part of steam drum 26 wherein the steam is separated from the mixture. Preferably, the steam/water mixture is introduced tangentially to the drum so that a cyclone-like circulation is maintained to increase the surface of the water within the drum. Saturated steam flows through duct 32 into separator 33 and from separator 33 is discharged for use in superheated conditions through duct 34.

At the discharge end of heat exchanger 4 are further dust separators 35, such as multiple cyclones, which are preferably air cooled to further cool the waste gas. Waste gas is discharged at the outlet portion of heat exchanger 4 after passing through separators 35 at a temperature of between 100° - 150° C.

The present invention provides not only for the efficient regulation of the inlet temperature to heat exchanger 4, but also provides efficient regulation of the time period in which hot bulk material is cooled within cooling bunker 1 so that the desired technological values, for example, solidity and/or porosity, can be obtained. Accordingly, by regulation of the inlet temperature of the cooling gas to the heat exchanger and by maintaining the flow rate constant of the gas entering the heat exchanger 4, a constant generation of steam can be obtained whereby hot bulk material may be permitted to operate as a regenerative heat storage for the necessary thermal energy required.

While a presently preferred embodiment of the invention has been shown and described, it is clear that the invention can be otherwise embodied as set forth in the appended claims. For example, a cooling station or bunker may have a number of closed circuits associated with it rather than one as shown and described herein. Such other circuits would preferably be substantially the same including a heat exchanger, by-pass line and the like.

What is claimed is:

1. A method for dry cooling hot bulk material within a closed system with a cooling gas, said method comprising:

a. directing a cooling gas through said bulk material to thereby cool said material and heat said cooling gas;

b. removing said heated cooling gas from said bulk material and mixing therewith a cold cooling gas;

c. cooling said mixture of heated and cold cooling gases to provided a cold stream of cooling gas; and d.i selectively diverting a portion of said cold stream of cooling gas to the removed heating cooling gas for mixing therewith in step b; and ii directing the undiverted portion of said cold stream of cooling gas to said bulk material for cooling same.

2. A method as set forth in claim 1 wherein said heated cooling gas is cleaned of coarse particles after mixing with said cold cooling gas.

3. A method as set forth in claim 1 wherein said diverted portion is selectively controlled to maintain a constant quantity of gas to be cooled and a temperature of less than about 650° C after mixing.

4. A method as set forth in claim 1 wherein said diverted portion of said cold cooling gas is conditioned to maintain the chemical analysis within selected limits prior to mixing with the heated cooling gas.

5. A method as set forth in claim 1 wherein said cooling gas is removed from said bulk material under reduced pressure.

6. A method as set forth in claim 1 including the steps:

i. intermittently supplying hot bulk material to a cooling station within said closed system; and ii. after cooling at least a portion of said bulk material, removing said cooled portion of material.

7. A method as set forth in claim 6 wherein said bulk material has a residence time within said cooling station of from between 3 and 4 hours.

8. A method as set forth in claim 6 wherein said hot bulk material is cooled to a temperature of less than about 200° C.

9. A means for dry cooling hot bulk material comprising:

a. a cooling station for receiving and holding hot bulk material;

b. a hot gas discharge duct connected to said cooling station at one end to a gas mixing means at its other end;

c. A gas mixing means connected to said discharge duct d. a heat exchanger having an inlet connected to said gas mixing means;

e. a circulation fan in communication with the discharge end of said heat exchanger;

f. a gas inlet duct connected to the outlet of said blower and to said cooling station; and g. a by-pass line in communication with said gas inlet duct and said mixing means for diverting a selected portion of gas from said inlet duct to said mixing means for mixture with hot gases discharged from the cooling station.

10. A means as set forth in claim 9 wherein said cooling station includes a distributor means connected to said inlet duct to direct a cooling gas within said cooling station.

11. A means as set forth in claim 9 wherein said cooling system includes an inlet having an air lock means and a discharge outlet having a lock gate.

12. A means as set forth in claim 9 wherein said by-pass line includes means for conditioning the gas circulating in said closed circuit.

13. A means as set forth in claim 9 wherein by-pass line and main inlet duct includes valve means for selectively controlling the flow of gas therethrough.

14. A means as set forth in claim 9 wherein said heat exchanger comprises a steam generator having a vertical steam drum.

15. A means as set forth in claim 9 including a coarse particle separator positioned between said mixing means and heat exchanger.

16. A means as set forth in claim 9 including at least one dust separator positioned between said heat exchanger and circulation fans.

* * * * *

UNITED STATES PATENT AND TRADEMARK OFFICE

CERTIFICATE OF CORRECTION

PATENT NO. : 4,037,330

DATED : July 26, 1977

INVENTOR(S) : Roland Kemmetmüller

It is certified that error appears in the above-identified patent and that said Letters Patent are hereby corrected as shown below:

Summary of the Invention, Column 2, line 46 after "recovered" delete "heart" and substitute therefor -- heat --

Summary of the Invention, Column 2, line 57, first word of the line, delete "division" and substitute therefor -- diversion --

Presently Preferred Embodiment, Column 4, line 10, after "200° C" delete "." and substitute therefor -- , --

Presently Preferred Embodiment, Column 4, line 30, delete "mizing" and substitute therefor -- mixing --

Presently Preferred Embodiment, Column 5, line 17, after "differential" insert -- between --

Presently Preferred Embodiment, Column 5, line 21, after "line 24" insert -- to --

Presently Preferred Embodiment, Column 5, line 52, after "water" delete "heat" and substitute therefor -- heater --

In the Claims, claim 9, Column 7, line 2, after "at one end" insert -- and --

In the Claims, claim 9, Column 7, line 6, after "duct" insert -- ; --

UNITED STATES PATENT AND TRADEMARK OFFICE

CERTIFICATE OF CORRECTION

PATENT NO. : 4,037,330

DATED : July 26, 1977

INVENTOR(S) : Roland Kemmetmuller

It is certified that error appears in the above-identified patent and that said Letters Patent are hereby corrected as shown below:

In the Claims, claim 11, Column 8, line 4, after "ing" delete "system" and substitute therefor -- station --

Signed and Sealed this

*Twenty-fourth* Day of *January 1978*

[SEAL]

*Attest:*

RUTH C. MASON
*Attesting Officer*

LUTRELLE F. PARKER
*Acting Commissioner of Patents and Trademarks*